US007155137B2

(12) United States Patent
Yasui et al.

(10) Patent No.: US 7,155,137 B2
(45) Date of Patent: Dec. 26, 2006

(54) PROCESS CARTRIDGE, DEVELOPING CARTRIDGE AND DEVELOPING ROLLER

(75) Inventors: Kojiro Yasui, Suntoh-gun (JP); Hironobu Isobe, Numazu (JP); Hiroshi Sato, Suntoh-gun (JP); Seiichi Shinohara, Mishima (JP); Yasufumi Yoshino, Numazu (JP); Syuhei Kawasaki, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/282,719

(22) Filed: Nov. 21, 2005

(65) Prior Publication Data

US 2006/0078358 A1 Apr. 13, 2006

Related U.S. Application Data

(62) Division of application No. 10/668,281, filed on Sep. 24, 2003, now Pat. No. 6,978,100.

(30) Foreign Application Priority Data

Sep. 30, 2002 (JP) ..... 2002-286584
Sep. 30, 2002 (JP) ..... 2002-286585

(51) Int. Cl.
*G03G 15/06* (2006.01)
*G03G 15/08* (2006.01)

(52) U.S. Cl. ..... 399/103; 399/222; 399/284

(58) Field of Classification Search ..... 399/102, 399/103, 105, 106, 109, 222, 249, 260, 264, 399/273, 274, 283, 284
See application file for complete search history.

(56) References Cited

U.S. PATENT DOCUMENTS 5,331,373 A 7/1994 Nomura et al. ..... 399/111
5,452,056 A 9/1995 Nomura et al. ..... 399/111
5,585,889 A 12/1996 Shishido et al. ..... 399/113
5,749,026 A 5/1998 Goldie ..... 399/103
5,765,077 A 6/1998 Sakurai et al. ..... 399/176
6,009,287 A 12/1999 Goldie ..... 399/103
6,064,843 A 5/2000 Isobe et al. ..... 399/111
6,115,567 A 9/2000 Kawai et al. ..... 399/106
6,128,462 A 10/2000 Kato et al. ..... 399/350
6,169,869 B1 1/2001 Inami et al. ..... 399/159
6,175,703 B1 1/2001 Nakazono et al. ..... 399/111

(Continued)

FOREIGN PATENT DOCUMENTS

JP 57-210372 12/1982

(Continued)

*Primary Examiner*—David M. Gray
*Assistant Examiner*—Ryan Gleitz
(74) *Attorney, Agent, or Firm*—Fitzpatrick, Cella, Harper & Scinto

(57) ABSTRACT

A developing cartridge is detachably mountable to a main assembly of an electrophotographic image forming apparatus. The cartridge includes a developing roller, for developing an electrostatic latent image formed on an electrophotographic photosensitive member, having an elastic roller portion and a shaft portion supporting the elastic roller portion, a developer regulating member; a protecting member including a contact portion provided for contact with the elastic roller portion when the protecting member is demountably mounted between the developing roller and the developer regulating member; and a supporting portion for supporting the contact portion and provided for contact with the elastic roller portion when the protecting member is demountably mounted between the developing roller and the developer regulating member. The contact portion has a hardness which is not less than a predetermined value and not more than a hardness of the elastic roller portion.

6 Claims, 8 Drawing Sheets

U.S. PATENT DOCUMENTS

| | | | | |
|---|---|---|---|---|
| 6,219,076 | B1 | 4/2001 | Sato | 347/131 |
| 6,317,574 | B1 | 11/2001 | Shinohara et al. | 399/176 |
| 6,324,370 | B1 | 11/2001 | Isobe et al. | 399/258 |
| 6,337,964 | B1 | 1/2002 | Inami et al. | 399/254 |
| 6,442,359 | B1 | 8/2002 | Numagami et al. | 399/111 |
| 6,463,233 | B1 | 10/2002 | Kojima et al. | 399/111 |
| 6,564,029 | B1 | 5/2003 | Kojima et al. | 399/258 |
| 6,810,221 | B1 | 10/2004 | Meyer et al. | |
| 2002/0110386 | A1 | 8/2002 | Kanno et al. | 399/111 |
| 2003/0086715 | A1 | 5/2003 | Miura et al. | 399/27 |
| 2003/0091353 | A1 | 5/2003 | Hiroshima et al. | 399/25 |

FOREIGN PATENT DOCUMENTS

| | | |
|---|---|---|
| JP | 5-224575 | 9/1993 |
| JP | 7-311536 | 11/1995 |
| JP | 2000-56535 A | 2/2000 |
| JP | 2000-132040 A | 5/2000 |
| JP | 2001-290370 | 10/2001 |

PROCESS CARTRIDGE, DEVELOPING CARTRIDGE AND DEVELOPING ROLLER

This application is a divisional application of application Ser. No. 10/668,281, filed Sep. 24, 2003, now issued as U.S. Pat. No. 6,978,100 on Dec. 20, 2005.

FIELD OF THE INVENTION AND RELATED ART

The present invention relates to a protective member removably attachable between a developer bearing member and a developer regulating member, a development cartridge having the protective member, and a process cartridge having the protective member.

Here, an image forming apparatus means an apparatus which forms an image on recording medium with the use of an electrophotographic image formation method. It includes, for example, various types of electrophotographic copying machines, electrophotographic printers (LED printers, laser beam printer, etc.), facsimile machines, word processors, etc.

A process cartridge means a cartridge, which is removably mountable in the main assembly of an image forming apparatus and has a photoconductive drum and a minimum of a developing means.

A development unit means a unit made up of a developing means for developing a latent image formed on an electrophotographic photoconductive drum, and auxiliary members therefor.

As the structure of an image forming apparatus for forming an image on recording medium with the use of an electrophotographic image forming method, the following has been known. That is, a latent image is formed on an electrophotographic photoconductive drum by selectively exposing the numerous points on the peripheral surface of the electrophotographic photoconductive drum, and is developed into a visual image formed of developer, by placing a development unit, which contains developer, in a manner to oppose the latent image. Then, the developer image is transferred onto a recording medium. In the case of a multicolor image forming apparatus, a multicolor image is obtained by carrying out the above described development process and transfer process, for each of the predetermined color components of an intended image.

Among various developing methods, a contact type developing method, which places a development roller in contact with a photoconductive drum, a jumping type developing method, which maintains a small gap between a development roller and a photoconductive drum, and the like methods, have been well-known. As for a means for reducing the amount of the maintenance work to be carried out by a user, a process cartridge system has been known, according to which the aforementioned development unit is placed in a cartridge removably mountable in the main assembly of an image forming apparatus.

There have been proposed various auxiliary members as means for maintaining the quality of a development unit, or a process cartridge, between the time when they are shipped from a manufacturer to the time when a user begins to use them. For example, Japanese Laid-open Patent Applications 7-311536 and 2001-290370, U.S. Pat. Nos. 5,749,026 and 6,009,287, etc., disclose such structural arrangements that dispose a piece of a sheet between a development blade and a development roller.

In the case of a contact type developing method in which nonmagnetic toner and a development roller are placed in contact with a photoconductive drum in order to form a toner image, it is desired that an elastic roller is employed as the development roller to avoid such a problem that a development roller is scratched or worn by the friction between the development roller and a photoconductive drum. In consideration of the chargeability of a development roller, the elastic layer of a development roller is formed of a single layer of solid rubber, a combination of a single layer of solid rubber and a thin layer of resin coated on the solid rubber layer, or the like.

There have been known various structural arrangements for keeping a toner supply roller, for example, a sponge roller, and a development blade for regulating the toner layer on a development roller, pressed directly on the peripheral surface of a development roller.

A development blade is a blade which is placed directly on the peripheral surface of the development roller to form the body of toner on the peripheral surface of a development roller, into a thin layer of toner while frictionally charging the toner (triboelectrical charge). It comprises a metallic member formed of phosphor bronze, stainless steel, carbon steel, or the like, and a pressing means. It is desired that the actual blade portion of the development blade is a piece of thin plate of springy metallic material such as phosphor bronze, stainless steel, carbon steel, or the like, or a piece of thin plate of the same material coated with a resin. A development blade is pressed directly on the peripheral surface of a development roller so that a predetermined amount of contact pressure is generated between the blade and roller. It is always kept in contact with the development roller while the apparatus is in use.

In a development unit structured so that a development blade is pressed directly on an elastic development roller, the development blade is always kept in contact with the development roller as described above. Thus, while a given portion of the elastic layer of the development roller is in the interface (contact area) between the development roller and development blade, it is kept in a deformed state, by the contact pressure.

Therefore, the portion of the elastic layer of a development roller that remains in the contact area between a development blade and development roller while a development unit is left unused for a substantial length of time, for example, from the time when a development unit is shipped from the manufacturer to the time when an end user begins to use it, sometimes fails to be restored to its original shape. The degree of failure, of course, is affected by various factors, for example, the vibrations, shocks, temperature, humidity, etc., to which the development unit is subjected while it remains unused.

If an end user begins to use an image forming apparatus before the deformed portion of the development roller therein fully restores its original shape, the contact pressure between the development blade and development roller slightly changes as the deformed portion of the development roller passes the contact area between the development blade and development roller, and the change in the contact pressure affects the thickness of the toner layer and the toner properties in terms of electrical charge, etc., sometimes resulting in the formation of an image suffering from horizontal lines, the intervals of which correspond to the rotational cycle of the development roller.

SUMMARY OF THE INVENTION

The primary object of the present invention is to provide: a protective member capable of controlling or preventing the compressional deformation or distortion of a development roller or a developer regulating member, during the distribution of a development cartridge or a process cartridge from the factory; a development cartridge employing such a protective member; and a process cartridge employing such a protective member.

Another object of the present invention is to provide: a protective member which is capable of controlling or preventing the compressional deformation or distortion of a development roller or a developer regulating member, during the distribution of a development cartridge or a process cartridge from the factory, and which can be easily inserted, or pulled out from, between a development roller and a developer regulating member; a development cartridge employing such a protective member; and a process cartridge employing such a protective member.

Another object of the present invention is to provide a protective member capable of controlling or preventing the problem that a development roller is charged when the protective member is removed; a development cartridge employing such a protective member; and a process cartridge employing such a protective member.

Another object of the present invention is to provide a protective member usable for a developing apparatus having: a development roller which is for developing an electrostatic latent image formed on an electrophotographic photoconductive member, and has an elastic roller portion; an axle portion for supporting the elastic roller portion; and a developer regulating member for regulating the amount of the developer allowed to remain adhered to the elastic roller portion, by being placed in contact with the elastic roller portion, comprising: a contacting portion disposed on the development roller side so that it contacts the elastic roller portion when the protective member is removably mounted between the development roller and developer regulating member; and a supporting portion for supporting the contacting portion, disposed on the developer regulating member side so that it contacts the developer regulating member when the protective member is removably mounted between the development roller and developer regulating member, wherein the hardness of the contacting portion is no less than a predetermined value, and is no more than the hardness of the elastic roller portion.

Another object of the present invention is to provide a development cartridge removably mountable in the main assembly of an electrophotographic image forming apparatus and comprising a development roller which is for developing an electrostatic latent image formed on an electrophotographic photoconductive member, and has an elastic roller portion and an axle portion for supporting the elastic roller portion; a developer regulating member for regulating the amount of the developer allowed to remain adhered to the elastic roller portion, by being placed in contact with the elastic roller portion; and a protective member removably disposed between the development roller and developer regulating member, and having a contacting portion disposed on the development roller side so that it contacts the elastic roller portion, and a supporting portion for supporting the contacting portion, disposed on the developer regulating member side so that it contacts the developer regulating member, wherein the hardness of the contacting portion is no less than a predetermined value, and is no more than the hardness of the elastic roller portion.

Another object of the present invention is to provide a process cartridge removably mountable in the main assembly of an electrophotographic image forming apparatus and comprising: an electrophotographic photoconductive member; a development roller which is for developing an electrostatic latent image formed on an electrophotographic photoconductive member, and has an elastic roller portion and an axle portion for supporting the elastic roller portion; a developer regulating member for regulating the amount of the developer allowed to remain adhered to the elastic roller portion, by being placed in contact with the elastic roller portion; and a protective member removably disposed between the development roller and developer regulating member, and having a contacting portion disposed on the development roller side so that it contacts the elastic roller portion, and a supporting portion for supporting the contacting portion, disposed on the developer regulating member side so that it contacts the developer regulating member, wherein the hardness of the contacting portion is no less than a predetermined value, and is no more than the hardness of the elastic roller portion.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described in detail with reference to the appended drawings. In the following descriptions, however, the measurements, materials, and shapes of the structural components in the embodiments, their positional relationships, etc., are not intended to limit the scope of the present invention, unless specifically noted.

(Embodiment 1)

Figure 1:
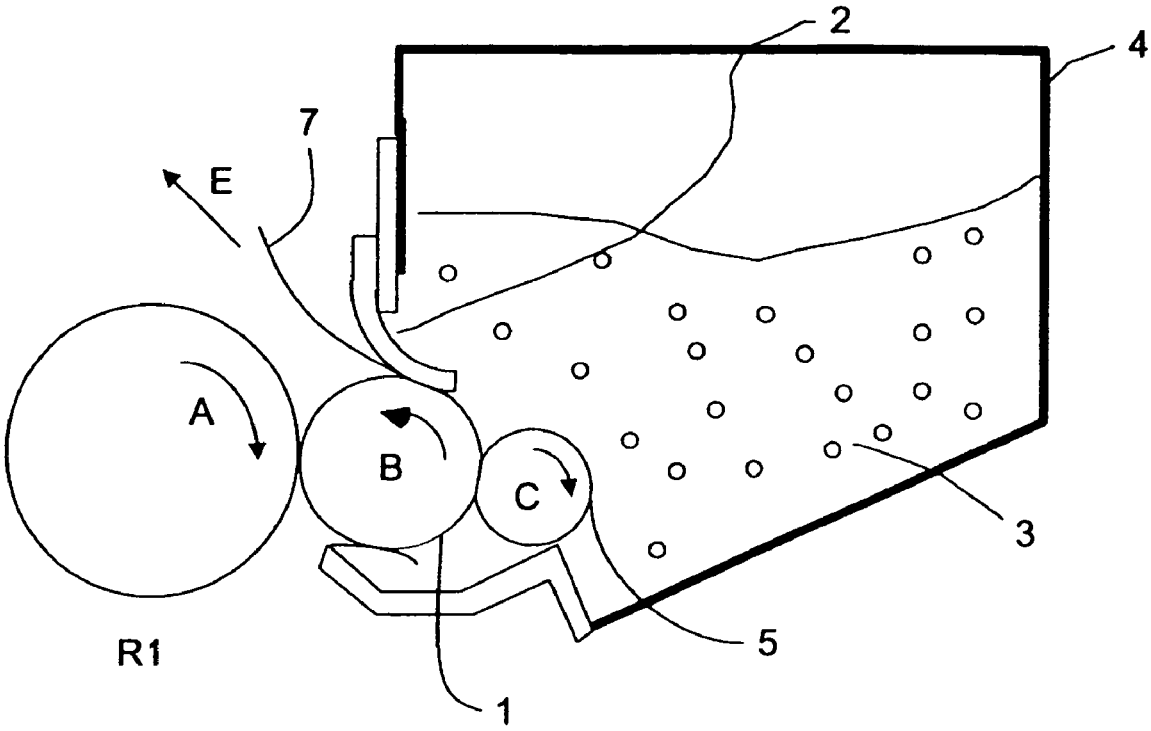
FIG. 1 is a schematic sectional view of the developing apparatus in the first embodiment of the present invention.
Figure 2:
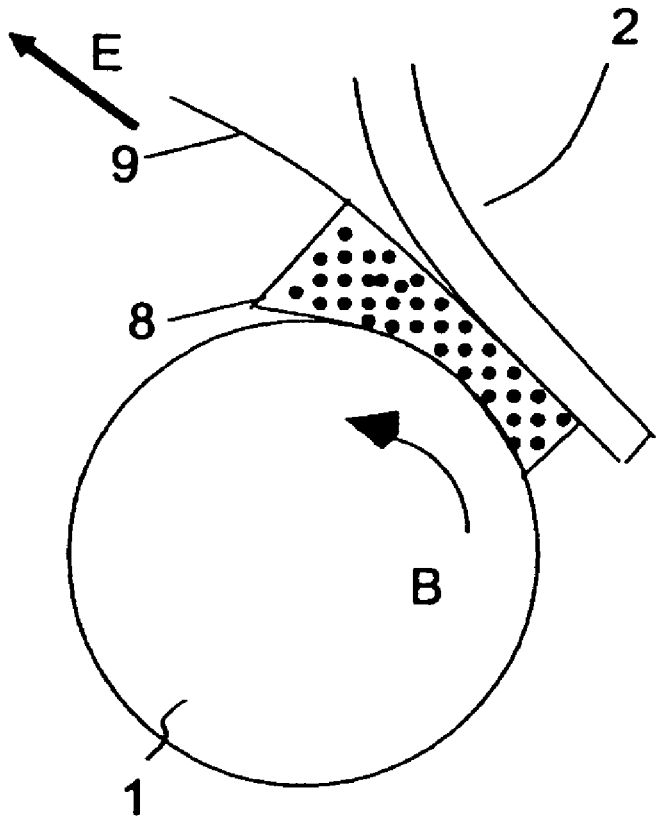
FIG. 2 is an enlarged sectional view of the essential portion of the developing apparatus in the first embodiment of the present invention.
Figure 3:
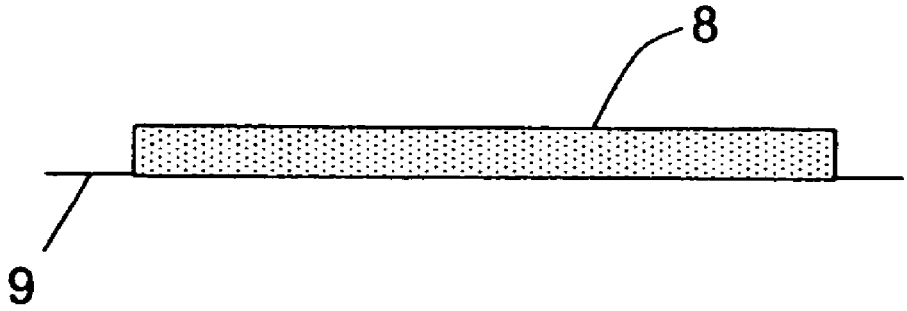
FIG. 3 is a schematic drawing of the pressure distributing member in the first embodiment of the present invention.

Referring to FIGS. 1 and 2, the developing apparatus in the first embodiment of the present invention will be described.

Referring to FIG. 1, a rotational drum R1 as a member for bearing an electrostatic latent image, is rotated in the direction indicated by an arrow mark A, whereas a development roller 1 as a member for bearing developer is rotated in the direction indicated by an arrow mark B. A blade 2 as a developer regulating means is positioned so that it regulates the amount of the developer on the peripheral surface of the sleeve (development roller). The developer 3 in a container 4 is conveyed to a developer bearing member 1 by a developer supplying member 5, which is rotated in the direction indicated by an arrow mark C. During this conveyance, the developer 3 is electrically charged by the friction between the developer 3 and the combination of the developer supplying member 5 and developer bearing member 1, adhering thereby to the peripheral surface of the developer bearing member 1. The developer 3 on the peripheral surface of the developer bearing member 1 is conveyed by the rotation of the developer bearing member 1, to the interface (contact area) between the developer bearing member 1 and a developer regulating means 2, in which it is regulated by the contact pressure between the developer regulating means 2 and developer bearing member 1, in the amount by which it is further conveyed. After being regulated in the amount by which it is further conveyed, the developer 3 is conveyed to the development area, that is, the interface (contact area) between the electrostatic latent image bearing member R1 and developer bearing member 1.

The developer 3 having been frictionally charged is conveyed to the exposed points of the latent image on the electrostatic latent image bearing member R1 by the electric field generated between the electrostatic latent image bearing member R1 and developer bearing member 1. The developer 3 which remains on the developer bearing member 1 is recovered by a developer supply member 5 into a container 4.

FIG. 2 is an enlarged sectional view of the contact area between the developer bearing member 1 and regulating means 2, with the presence of the protective member between the two means 1 and 2, for describing in detail the first embodiment of the present invention.

Referring to FIG. 2, before the developing apparatus is used for the very first time, the protective member 7 is to be pulled out of the developing apparatus in the direction indicated by an arrow mark E, so that the peripheral surface of the developer bearing member 1 comes into contact with the regulating means 2.

The protective member 7 in this embodiment is different from a conventional protective member in that it is made up of a foamed portion 8, as a member which contacts the developer (or developer bearing member), and a sheet 9 as a member for supporting the foamed portion 8. The foamed portion 8 is formed of high polymer.

Also referring to FIG. 2, the protective member 7 is inserted into the contact area between the developer bearing member 1 and regulating means 2 in such a manner that the foamed portion 8 formed of high polymer contacts the developer bearing member 1, whereas the sheet 9 contacts the regulating means 2.

In this embodiment, a piece of phosphor bronze which is 0.1 mm in thickness is employed as the regulating means, and the developer bearing member 1 is formed of an elastic material such as rubber.

In consideration of the degree of ease with which the foamed portion 8 formed of polymer can be inserted or pulled out, and the effectiveness of the foamed portion 8 as a pressure distributing member, the thickness of the foamed portion 8 is desired to be in the range of 0.5–2 mm. In order to prevent the regulating means 2 from being damaged when the protective member 7 is pulled out when the development unit is used for the first time, the material for the sheet 9 is desired to be low in friction.

The hardness of the developer bearing member 1 in this embodiment was in the range of 45°–55° (Asker C scale).

Then, the correlation between the hardness (Asker C scale) of the protective member 7 and the level of the image imperfection resulting from the compressional deformation of the developer bearing member 1 was examined. The method used for the examination was as follows. Several foamed members 8 different in hardness were prepared as the protective member to be sandwiched between a development blade and a development roller. Then, the images formed with the use of the foamed members 8 different in hardness were examined in terms of the imperfections traceable to the compressional deformation of the developer bearing member 1.

Figure 4:
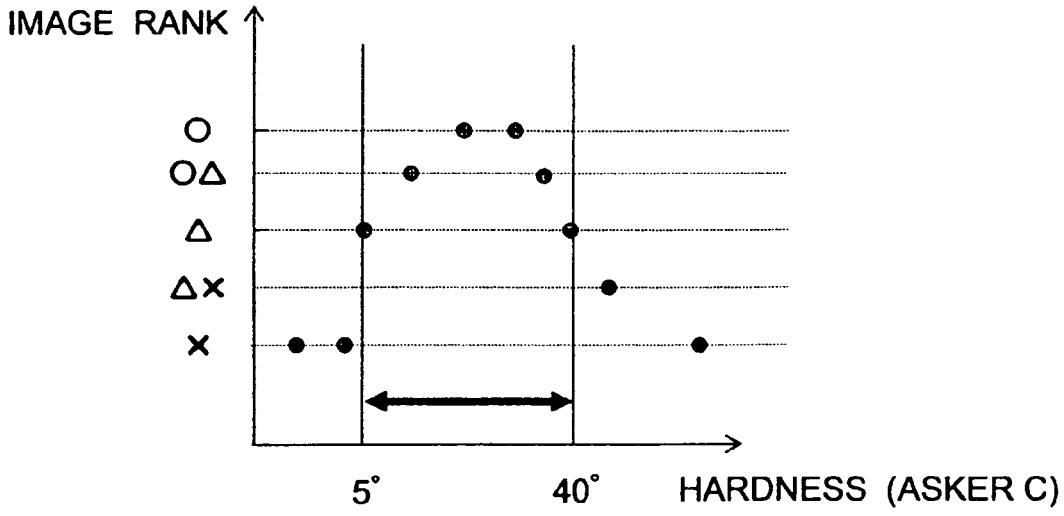
FIG. 4 is a graph showing the results of the studies of the first embodiment of the present invention.

The results of the examination are given in FIG. 4. The abscissa axis represents the hardness of the foamed high polymer portion 8, and the ordinate axis represents the level of image imperfection resulting from the compressional deformation of the developer bearing member 1, which occurred in the contact area between the regulating member 2 and developer bearing member 1.

To describe the level of the compressional deformation of the developer bearing member 1 in terms of the image quality, O represents the level at which no image imperfection occurred, and Δ represents the level at which a slight image imperfection occurred only at the initial stage of the very first usage of the development unit (deformed portion of development roller fully recovered to the condition in which it did not cause any image imperfection in practical terms). X represents the level at which the development roller never completely recovered to the condition in which it can form an image free of imperfection. The combination of O and Δ, and the combination of Δ and X, represent corresponding intermediary levels.

The results show that when a foamed high polymer portion 8, the hardness of which was in the range of 5°–40° was used, the image imperfection traceable to the compressional deformation of the elastic developer bearing member 1 did not occur; excellent images were obtained. This proved that the hardness range of 5°–40° was the optimum hardness range for the high polymer foamed portion 8.

Further, the correlation between the volume resistivity (Ω·cm) of the protective member 7 and the level of the memory, in terms of the image quality, created in the portion of the development roller, which was in the contact area between the protective member 7 and developer bearing member 1, when the protective member 7 was pulled out, was studied using the following method. A plurality of protective members 7 different in the volume resistivity of the foamed high polymer portion 8 were prepared. Then, a plurality of developing devices were prepared, which were the same in the surface resistivity, that is, $10^7$ Ω, and were different in the volume resistivity of the foamed high polymer portion 8 of the protective member 7 sandwiched between the regulating means 2 and developer bearing member 1.

Figure 5:
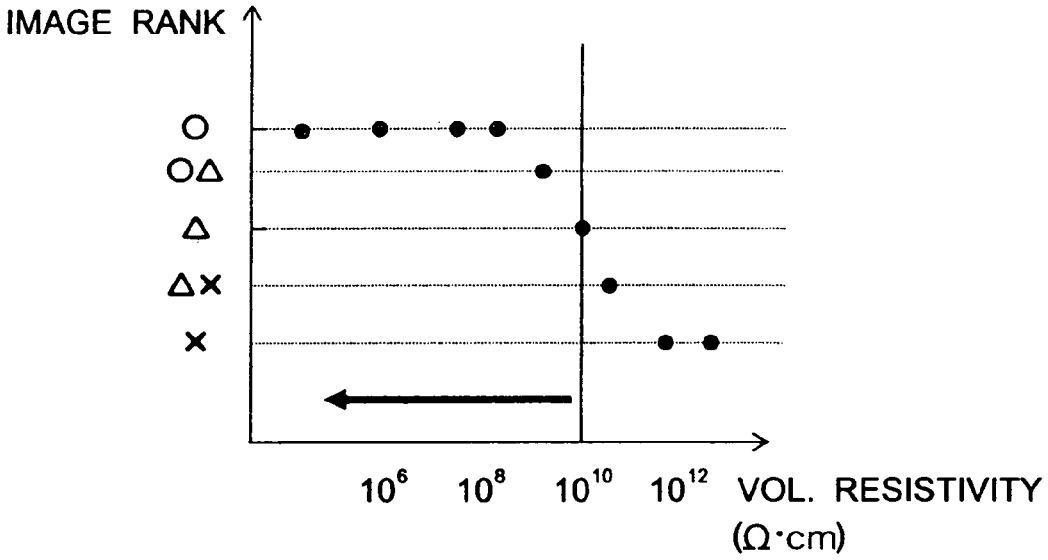
FIG. 5 is a graph showing also the results of the studies of the first embodiment of the present invention.

The results of the studies are given in FIG. 5. The abscissa axis represents the volume resistivity of the foamed high polymer portion 8, and the ordinate axis represents the level of the memory, in terms of image quality, which is created by friction in the contact area between the protective member 7 and developer bearing member 1 when the protective member 7 was pulled out, and which resulted in image imperfections.

To describe the level of the memory, in the terms of image quality, which was caused by the friction between the protective member 7 and resulted in image imperfections, O represents the level at which no image imperfection occurred, and Δ represents the level at which slight image imperfection occurred only at the initial stage of the very first usage of the development unit (memory virtually disappeared, causing no image imperfection in practical terms). X represents the level at which image imperfections occurred from the beginning of the very first usage of the development unit, and at which the formation of a small number of images could not restore the development roller to the condition in which an image free of imperfection could be formed. The combination of O and Δ, and the combination of Δ and X, represent corresponding intermediary levels.

The results showed that when the foamed high polymer members 8, the volume resistivity of which was no more than $10^{10}$ Ω·cm, were employed, no image imperfection resulting from the memory created in the portion of the developer bearing member 1 in the contact area between the foamed high polymer portion 8 and developer bearing member 1 when the protective member 7 was pulled out of the contact area, occurred; excellent images were obtained. This proved that the optimum volume resistivity for the foamed high polymer portion 8 is no more than $10^{10}$ Ω·cm, where the level of the deformation in terms of image quality is Δ or higher.

(Embodiment 2)

Figure 6:
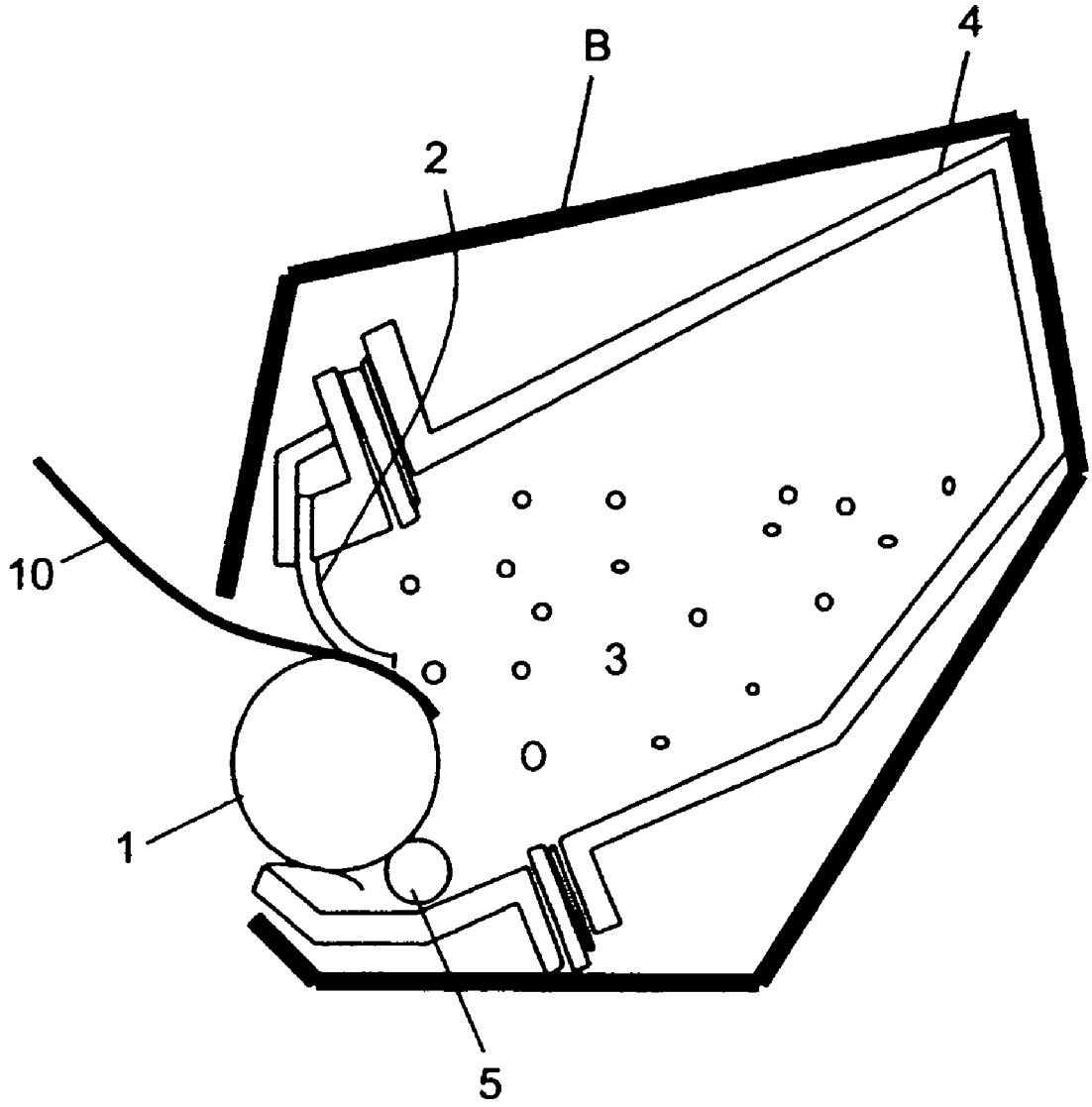
FIG. 6 is a schematic sectional view of the developing apparatus in the second embodiment of the present invention.

FIG. 6 shows the development unit in the second embodiment of the present invention.

In this embodiment, the developer bearing member 1, the regulating means 2, the developer 3, the container 4, the developer supply member 5, etc., in the first embodiment are integrally disposed in a container B as a protective shell for these structural components. A protective member 10 employed in this embodiment is also placed between the developer bearing member 1 and developer regulating member 2 as in the first embodiment. The members in this embodiment, which are the same in function those in the first embodiment, are given the same reference symbols as those given in the first embodiment, and will not be described.

Referring to FIG. 6, the process cartridge in this embodiment is characterized in that it is removably mountable in the main assembly of an image forming apparatus. It is to be mounted into the apparatus main assembly after the removal of its protective member 10.

Figure 7:
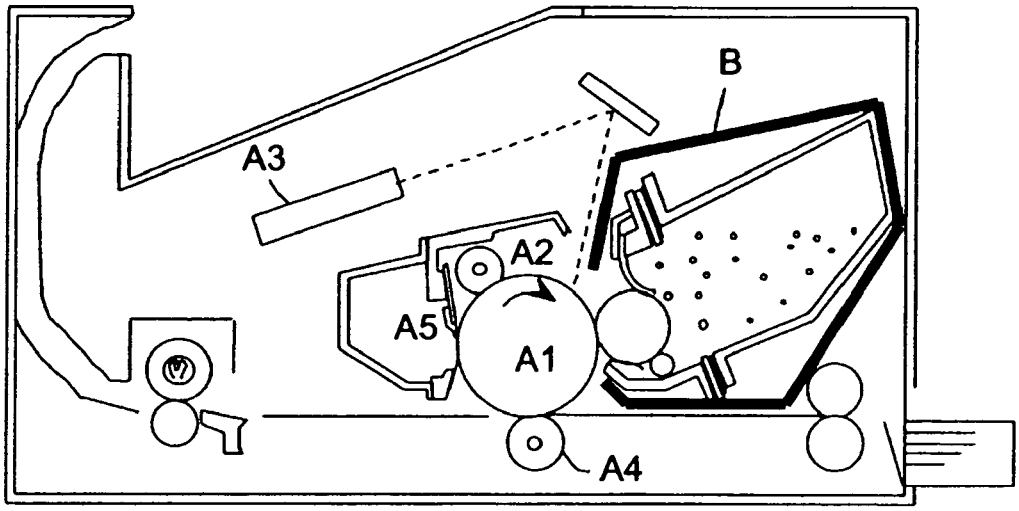
FIG. 7 is a schematic sectional view of an image forming apparatus employing the developing apparatus in the second embodiment of the present invention.

Next, referring to FIG. 7, mounted in the image forming apparatus is a process cartridge B comprising: a photoconductive drum 1 as an image bearing member; a charge roller A2 as a charging means for uniformly charging the photoconductive drum A1; an exposing apparatus A3 as an exposing means for forming an electrostatic latent image on the charged portion of the photoconductive drum A1; and a developing means for developing an electrostatic latent image into a visual image with the use of developer. The process cartridge B also comprises a cleaning apparatus A5 which recovers the small amount of developer remaining on the photoconductive drum A1 after the transfer of a developer image onto a transfer medium A4, by scraping it away from the photoconductive drum A1, and recycling it for the following image formation cycles.

With the employment of the above described process cartridge in this embodiment, it is possible to reduce the amount of time and labor required to maintain the developing means which is substantially greater in wear and tear than the other components, and also to prevent the formation of an image suffering from the image imperfections traceable to the compressional deformation of the developer bearing member 1, or the memory created when the protective member 10 is pulled out from between the regulating means 2 and developer bearing member 1.

As described above, this embodiment of the present invention makes it possible to prevent the formation of an image suffering from the image imperfections traceable to the compressional deformation or distortion of the developer bearing member 1 which occurs during the shipment period, that is, the period from when a development cartridge is shipped out of a factory to when the development cartridge is used for the first time by an end user.

Further, this embodiment of the present invention makes it possible to eliminate the adverse effects, upon image formation, of the electrostatic memory created in a developer bearing member by the rubbing between the protective member 10 and developer bearing member 1 when the protective member 10 is removed. Therefore, an excellent image can be formed even when the process cartridge is used for the very first time.

(Embodiment 3)

Figure 8:
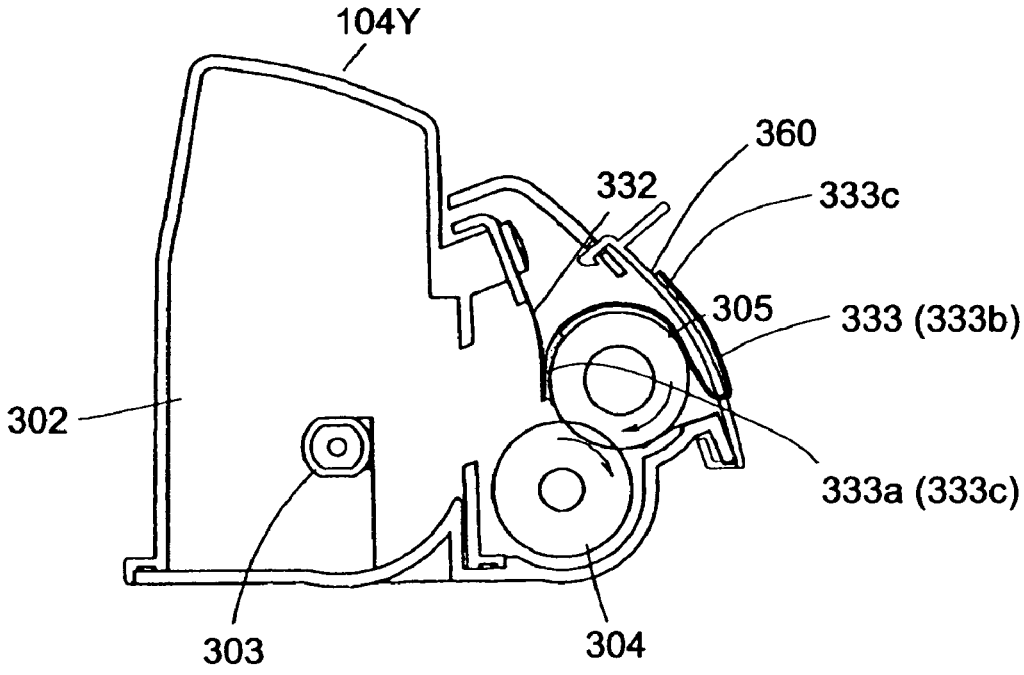
FIG. 8 is a sectional view of the development cartridge, in the third embodiment of the present invention, into which a protective member is being inserted.
Figure 9:
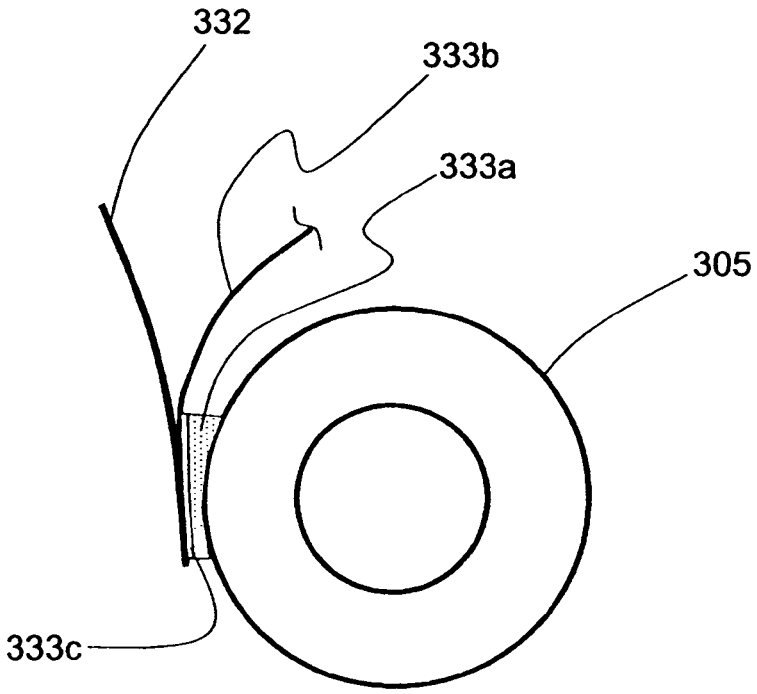
FIG. 9 is a detailed sectional view of the protective member (pressure distributing member formed of urethane foam) in the third embodiment of the present invention.
Figure 10:
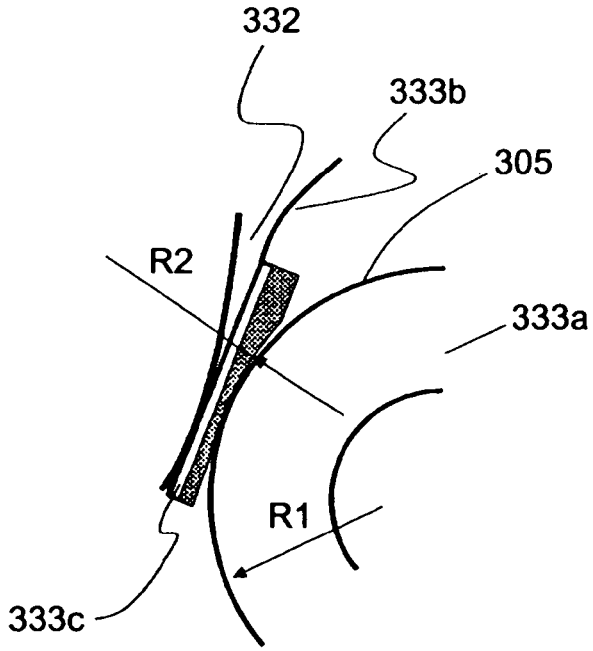
FIG. 10 is a detailed sectional view of another protective member (pressure distributing member formed of soft resin) in the third embodiment of the present invention.
Figure 11:
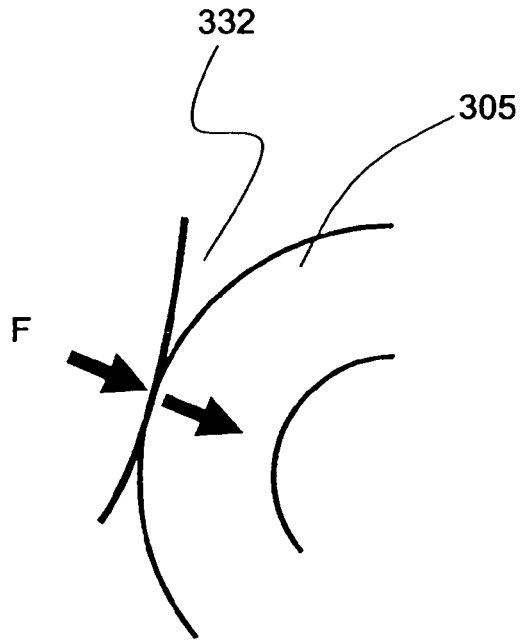
FIG. 11 is a detailed sectional view of the contact area, between a development blade and a development roller, with the presence of no protective member between the blade and roller.

Referring to FIGS. 8–12, the outline of the third embodiment of the present invention will be described. FIGS. 8 and 9 are sectional views of the development cartridge, in which the protective member in this embodiment has been properly inserted. FIG. 11 is a sectional view of a development cartridge, in which the protective member has not been inserted.

Referring to FIG. 8, the protective member 333 comprises: a pressure distributing portion 333*a*, as the actual protective portion, having the function of increasing the size of the area across which the contact pressure generated by the development blade 332 and development roller 305 is distributed; and an auxiliary portion 333*b* as a supporting portion, to which the pressure distributing portion 333*a* is bonded. The protective member 333 is attached to the development cartridge in such a manner that one end of the auxiliary member 333*b* is placed in contact with the development blade 332, with the pressure distributing portion 333*a* sandwiched between the auxiliary portion 333*b* and development roller 305. The other end (bonding portion 333*c*) of the auxiliary portion 333*b* is attached to the protective cover 360 with the use of a piece of two-sided adhesive tape or the like.

Thus, during the period from when a process cartridge is manufactured to when the process cartridge is used by an end user for the first time, the contact pressure generated between the development blade 332 and development roller 305 remains distributed across the larger area of the peripheral surface of the development roller 305 to prevent the deformation of the development roller 305. As for the removal of the protective member 333, as the protective cover 360 is removed when the process cartridge is used for the first time, the protective member 333 is automatically removed along with the protective cover 360, preventing thereby the problem that an end user forgets to remove the protective member 333 when the process cartridge is used for the first time.

Next, the details of the embodiments of the present invention will be described.

(Pressure Distribution Mechanism)

First, the pressure distribution mechanism will be described. Referring to FIG. 11, as the development blade 332 is pressed on the development roller 305 so that a contact pressure (linear pressure) of roughly 1.96 N/m (20 gf/cm) is generated, the width of the contact area between the development roller 305 and development blade 332, becomes roughly 1 mm. Thus, the pressure the development roller 305 receives per unit of surface is approximately 19.6×N/m (2 gf/mm$^2$).

Figure 12:
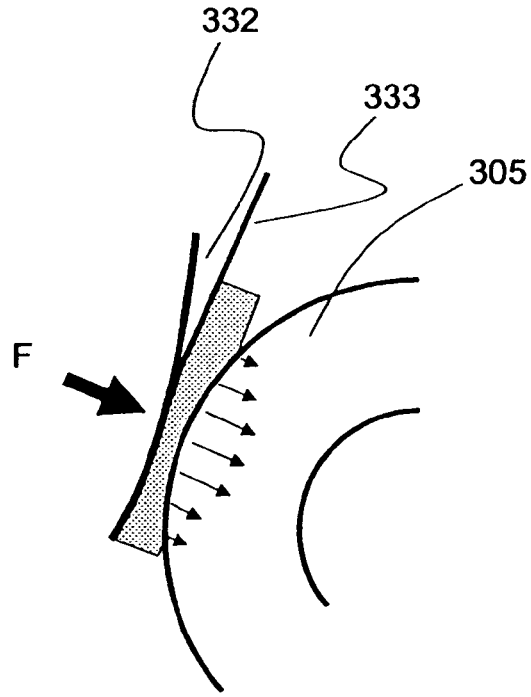
FIG. 12 is a detailed sectional view of the contact area, between a development blade and a development roller, with the presence of a protective member between the blade and roller.

Thus, the placement of the pressure distributing portion 333*a* of the protective member 333 between the development roller 305 and development blade 332, as shown in FIG. 12, causes the compressional deformation of the pressure distributing portion 333*a*. As a result, the width of the area of the development roller 305, which is subjected to the contact pressure, is increased to approximately 3–5 mm, according to the experiments, which in turn reduces the amount of the contact pressure per unit of area, to which the development roller 305 is subjected, making it possible to control the compression deformation of the development roller 305.

(Pressure Distributing Member)

Next, the pressure distributing portion 333*a*, that is, the preferable pressure distributing portion, in this embodiment, will be described in detail. The pressure distributing portion 333*a* to be sandwiched between the development roller 305 and development blade 332 is desired to have the following functions, in addition to the pressure distributing function.

(1) It does not chemically attack other structural components while the process cartridge is in storage for a given length of time;

(2) It does not become fuzzy on surfaces, when it is subjected to the vibrations, which occur during its shipment or the like; and (3) It is superior in operability.

Further, experiments revealed that the following two structural arrangements were preferable.

First, it became evident that the usage of urethane foam with the thickness range of 0.5 mm–2 mm, as the material for the pressure distributing portion, as shown in FIG. 9, gave the pressure distributing portion preferable characteristics, not only in terms of pressure distribution, but also in terms of the aforementioned chemical attack, fuzz, and operability, etc.

However, when the thickness of urethane foam was no less than 2 mm, it was extremely difficult to insert, or pull out, the protective member. On the other hand, when the thickness of the urethane foam was no more than 0.5 mm, the pressure distributing member was not satisfactorily effective to distribute the contact pressure. Further, when cotton pile, or the like, with a staple length of roughly 1.2 mm was used as the material for the pressure distributing portion, the pressure distributing member was satisfactory in terms of pressure distribution, but the problems regarding the fuzz could not be solved.

Further, experiments proved that paper, polyethylene-terephthalate sheet, and the like, had virtually no ability to distribute the contact pressure. Thus, urethane foam with the thickness range of 0.5–2 mm is desirable as the material for the actual pressure distributing portion 333*a* of the protective member 333 which must meet the requirements that a pressure distributing portion is effective in the contact pressure distribution; does not chemically attack other structural components while the process cartridge is in storage for a given length of time; does not develop fuzz; and is superior in operability.

Referring to FIG. 10, in one of the experiments, the pressure distributing portion 333*a* as a pressure distributing means is formed of a resin such as polyethylene, polypropylene, etc., instead of urethane foam.

In this case, the radius R2 of the curvature of the development roller side of the pressure distributing portion 333*a*, in terms of the sectional view, was made slightly larger than the radius R1 of the curvature of the development roller (R2>R1). The experiment confirmed that such a structural arrangement had the pressure distributing effect.

In the case of the protective member having a pressure distributing portion formed of urethane foam, as the protective member was inserted between the development roller 305 and development blade 332, the pressure distributing portion (urethane foam) was compressed by the contact pressure generated between the development blade 332 and development roller 305, conforming in shape to the peripheral surface of the development roller 305. As a result, the contact pressure was distributed across the wider area of the development roller 305. In comparison, in the case of the protective member having a pressure distributing portion formed of such a resin as polyethylene or polypropylene, the pressure distributing portion is shaped so that it roughly conforms in shape to the peripheral surface of the development roller 305. This type of protective member was similarly effective for the wider pressure distribution as the protective member having the pressure distributing portion formed of urethane foam.

(Auxiliary Portion)

The pressure distributing portion 333*a* of the protective member 333, which is formed of a material such as urethane foam which is made with the use of a foaming agent is relatively large in its friction against the development roller 305 or development blade 332, and is insufficient in structural strength. Therefore, the pressure distributing portion 333*a* alone is difficult to insert when assembling a development cartridge or a process cartridge, and also is difficult to pull out. In other words, it is inferior in terms of operability.

In comparison, in the case of the pressure distributing portion 333*a* molded of a resin, there is the possibility that it comes into contact with the development roller 305, or that a user forgets to pull it out.

Therefore, the pressure distributing portion 333*a* is integrated with the auxiliary portion 333*b* as shown in FIGS. 8 and 9. As for the material for the auxiliary portion 333*b*, the experiments showed that when the development blade 332 was a piece of thin springy plate of phosphor bronze, stainless steel, or the like, which was not coated with resin, a sheet of polyethylene-terephthalate with a thickness of approximately 150 μm was preferable.

Further, the experiments showed that when the surface of the development blade 332 was coated with resin, the auxiliary portion 333*b* sometimes damaged the surface of the development blade 332 when the protective member 333 was pulled out. In such a case, it was desired that the area of the auxiliary portion 333*b*, which came into contact with the development blade 332, was coated with a lubricating substance, for example, Teflon (registered commercial name), silicon, or the like. The experiments showed that a separation sheet was preferable as the lubricating means.

The experiments also showed that in either case, in terms of ease of insertion or extraction, the auxiliary portion 333*b* was desired to be placed on the development blade side rather than the development roller side.

(Integration of Protective Member with Protective Cover)

For the purpose of improving the protective member 333 in terms of usability, that is, assuring that the protective member 333 can be easily pulled out by a user, the protective member 333 may be integrated with the protective cover 306; the portion of the protective member 333 opposite to the edge portion sandwiched between the development blade 332 and development roller 305 may be bonded to the protective cover 306. With the integration of the protective member 333 with the protective cover 306, it is assured without asking for a particular attention from a user that the protective member 333 will be removed.

(Structure of Protective Member (Bonding of Various Portions))

As described above, the protective member 333 has the pressure distributing portion 333*a* and auxiliary portion 333*b*. It is structured so that, as it is inserted, the pressure distributing portion 333*a* contacts the development roller 305, and the auxiliary portion 333*b* contacts the development blade 332, and that it is attached to the protective cover 360 by the edge portion opposite to the edge portion to be sandwiched between the development roller 305 and development blade 332.

As the means (bonding layer 333*c*) for attaching the pressure distributing portion 333*a* to the auxiliary portion 333*b*, and the means for attaching the auxiliary portion 333*b* to the protective cover 306, two-sided adhesive tape was used. This does not mean that the bonding agent is limited to two-side adhesive tape. For example, bonding means such as hot-melt or adhesive may be used as long as they do not chemically attach other structural components such as the development roller, photoconductive drum, etc., and are sufficient in adhesive strength. Further, there is no specific restriction regarding the areas of the pressure distributing portion 333*a* and auxiliary portion 333*b* by which they are attached, as long as the two portions 333*a* and 333*b* do not become separated from where they are attached.

Up to this point, the embodiments of the present invention have been described with reference to a color image forming apparatus. This does not mean that the application of the present invention is to be limited to a color image forming apparatus. In other words, needless to say, the present invention is applicable to any structural arrangement in which the protective member 333 for more widely distributing the contact pressure generated between the development roller 305 and development blade 332 across the peripheral surface of the development roller 305, is inserted between the development blade 332 and development roller 305 in a manner to be sandwiched by the blade 332 and roller 305.

As described above, according to the embodiments of the present invention, it is possible to keep more widely distributed, the contact pressure between a development blade and development roller, from when a process cartridge or a development unit is manufactured to when the process cartridge or development unit is used for the first time by an end user. Therefore, the compressional deformation of a development roller caused by the contact pressure between a development blade and a development roller can be prevented, making it possible to form an excellent image.

As is evident from the descriptions given above, according to the present invention, it is possible to control or prevent the problem that a development roller and/or a developer regulating member is deformed or distorted by the contact pressure generated between them.

Further, according to the present invention, a protective member is designed so that its supporting portion for supporting its pressure distributing portion contacts the developer regulating member. Therefore, the protective member can be easily inserted, or pulled out from, between the development roller and developer regulating member.

While the invention has been described with reference to the structures disclosed herein, it is not confined to the details set forth, and this application is intended to cover such modifications or changes as may come within the purposes of the improvements or the scope of the following claims.

What is claimed is:

1. A developing cartridge detachably mountable to a main assembly of an electrophotographic photosensitive member, said developing cartridge comprising:

a developing roller, configured and positioned to develop an electrostatic latent image formed on an electrophotographic photosensitive member, having an elastic roller portion and a shaft portion supporting said elastic roller portion;

a developer regulating member contactable to said elastic roller portion and configured and positioned to regulate the amount of the developer deposited on said elastic roller portion; and a protecting member including:

a portion sandwiched between said elastic roller portion and said developer regulating member when said protecting member is demountably mounted between said developing roller and said developer regulating member, wherein said portion to be sandwiched is compressed and deformed between said elastic roller portion and said developer regulating member; and a supporting portion configured and positioned to support said portion to be sandwiched, wherein the width of contact between said portion to be sandwiched and said elastic roller portion when said portion to be sandwiched is sandwiched between said elastic roller portion and said developer regulating member, is larger than the width of contact between said developer regulating member and said elastic roller portion when said portion to be sandwiched is not sandwiched between said elastic roller portion and said developer regulating member, wherein when said protecting member is mounted between said elastic roller portion and said developer regulating member, said portion to be sandwiched contacts said elastic roller portion, and said supporting portion contacts said developer regulating member.

2. A developing cartridge according to claim 1, wherein said supporting portion includes a sheet of polyethylene terephthalate resin material.

3. A developing cartridge according to claim 1 or 2, wherein said portion to be sandwiched has a thickness of 0.5 mm–2 mm.

4. A process cartridge detachably mountable to a main assembly of an electrophotographic image forming apparatus, said process cartridge comprising:

an electrophotographic photosensitive member;

a developing roller, configured and positioned to develop an electrostatic latent image formed on said electrophotographic photosensitive member, having an elastic roller portion and a shaft portion supporting said elastic roller portion;

a developer regulating member contactable to said elastic roller portion and configured and positioned to regulate the amount of the developer deposited on said elastic roller portion; and a protecting member including:

a portion sandwiched between said elastic roller portion and said developer regulating member when said protecting member is demountably mounted between said developing roller and said developer regulating member, wherein said portion to be sandwiched is compressed and deformed between said elastic roller portion and said developer regulating member; and a supporting portion configured and positioned to support said portion to be sandwiched, wherein the width of contact between said portion to be sandwiched and said elastic roller portion when said portion to be sandwiched is sandwiched between said elastic roller portion and said developer regulating member, is larger than the width of contact between said developer regulating member and said elastic roller portion when said portion to be sandwiched member is not sandwiched between said elastic roller portion and said developer regulating member wherein when said protecting member is mounted between said elastic roller portion and said developer regulating member, said portion to be sandwiched contacts said elastic roller portion, and said supporting portion contacts said developer regulating member.

5. A process cartridge according to claim 4, wherein said supporting portion includes a sheet of polyethylene terephthalate resin material.

6. A process cartridge according to claim 4 or 5, wherein said portion to be sandwiched has a thickness of 0.5 mm–2 mm.

* * * * *

UNITED STATES PATENT AND TRADEMARK OFFICE

CERTIFICATE OF CORRECTION

PATENT NO. : 7,155,137 B2
APPLICATION NO. : 11/282719
DATED : December 26, 2006
INVENTOR(S) : Kojiro Yasui et al.

It is certified that error appears in the above-identified patent and that said Letters Patent is hereby corrected as shown below:

COLUMN 7:
Line 51, "those in" should read --as those in--.

Signed and Sealed this

Twenty-ninth Day of July, 2008

JON W. DUDAS
*Director of the United States Patent and Trademark Office*